United States Patent [19]

Rodgers

[11] 4,216,660

[45] Aug. 12, 1980

[54] HEAT GENERATOR

[75] Inventor: Steven S. Rodgers, Avalon, N.J.

[73] Assignee: T.E.S., Inc., Atlantic City, N.J.

[21] Appl. No.: 902,982

[22] Filed: May 4, 1978

[51] Int. Cl.[3] ..... F25B 27/02; F25B 43/00

[52] U.S. Cl. ..... 62/238; 62/503

[58] Field of Search ..... 62/503, 512, 468, 469, 62/470, 471, 238 E

[56] References Cited

U.S. PATENT DOCUMENTS

| | | | |
|---|---|---|---|
| 2,690,649 | 10/1954 | Borgerd | 62/238 E |
| 2,696,085 | 12/1954 | Ruff | 62/238 E |
| 3,765,192 | 10/1973 | Root | 62/503 |
| 3,872,687 | 3/1975 | Bottom et al. | 62/503 |
| 3,986,664 | 10/1976 | Gustafsson | 62/238 E |
| 4,041,726 | 8/1977 | Mueller et al. | 62/238 E |
| 4,139,356 | 2/1979 | Hattori | 62/503 |

*Primary Examiner*—Lloyd L. King

*Attorney, Agent, or Firm*—Thomas A. Lennox

[57] ABSTRACT

A heat generator is provided that includes a compressor driven by electricity that increases the temperature and pressure of a FREON composition which passes through a heat exchanger to generate heat for other uses, a flow restrictor which feeds a fluid expansion tank which, in turn, feeds the compressor. The system is characterized such that no significant heat transfer is made to the generator from ambient conditions and a limited change of FREON is used in the generator.

20 Claims, 5 Drawing Figures

HEAT GENERATOR

BACKGROUND OF THE INVENTION

The apparatus of this invention falls into the general field of heat generators and is most closely compared with the now common heat pump system. There is an increasing need for heat generators which can convert electricity to heat with increased efficiency.

The heat pump system utilizes three components, a compressor, an evaporator and a condenser. A key element of the heat pump is the evaporator which serves to absorb heat from a heat sump such as the outside air, well water, a swimming pool or the ground. This heat is later transferred to the area being warmed such as the interior of a house. The evaporator must, of necessity, be located remote from the unit providing heat to the interior of the house. The unit is sometimes installed in a window casing or in a wall such that access to the external heat source and the area to be warmed is provided. It is nearly impossible to make the heat pump portable.

In addition, the efficiency of a heat pump decreases rapidly with the temperature of the heat. For example, maximum efficiency is obtained when the heat sump source is in the 40° to 50° F. range. The efficiency may be about 2.5 but the efficiency drops rapidly as the sump temperature is lowered until it reaches about 0.85 when the heat source is at 0° F. As a result, the heat pump is not practical in the winter of many climates.

An object of this invention is to provide a heat generator which does not draw heat from a heat sump.

Another object of this invention is to provide a heat generator which has all of the advantages of the heat pump but avoids the inefficiency and limitations of an evaporator external to the space being heated.

A particular object of this invention is to provide a heat generator which is fully portable.

A further object of this invention is to provide a heat generator with its operation and efficiency essentially independent of the outside environment and of the ambient temperature where the heat generator is located.

A specific object of this invention is to provide a heat generator with increased efficiency utilizing only an energy source to operate a compressor.

A specific object of this invention is to provide a heat generator which is clean and does not affect the environment in any way whatsoever.

A specific object of this invention is to provide a heat generator which may be easily controlled with a minimum of complexity since it is not dependant upon or affected by the outside environment or the ambient temperature.

Further objects will be apparent as the invention is further described in detail.

DESCRIPTION OF PRIOR ART

The following patents all describe various heat pump devices: U.S. Pat. No. 2,241,070 to McLenegan; U.S. Pat. No. 2,483,896 to Gay; U.S. Pat. No. 2,619,326 to McLenegan; U.S. Pat. No. 2,723,083 to Bary; U.S. Pat. No. 3,992,876 to Wetherington, Jr., et al; U.S. Pat. No. 3,933,004 to Carter et al; U.S. Pat. No. 3,984,050 to Gustafsson; U.S. Patent No. 3,989,183 to Gustafsson; U.S. Pat. No. 4,012,920 to Kirschbaum; and U.S. Pat. No. 4,005,963 to Shoji, et al.

All of these patents utilize an evaporator/condenser and none satisfy the above objects. None of the patents describe or suggest the present invention.

SUMMARY OF THE INVENTION

The heating apparatus of this invention includes a compressor with an inlet and an outlet driven by a prime mover such as electricity. Conduit connecting all of the elements in series is attached to the inlet and outlet of the compressor and forms a flow circuit to all of the components of the apparatus to carry a heat exchange fluid from the compressor around the circuit and back to the compressor. The heat exchange fluid is charged to the apparatus at a pressure of 10 to 100 psig and is preferably maintained in a gaseous or flash liquid state throughout the entire circuit. The heat exchange fluid is confined within the conduit circuit. A heat exchanger is provided to transfer heat from the heat exchange fluid to a second fluid for use outside the apparatus. A flow restricting means is interposed in the conduit circuit between the heat exchanger and an expansion system to place the fluid in a gaseous state. The expansion system is controlled so that there is no significant heat transfer from the ambient to the expansion system.

DESCRIPTION OF THE PREFERRED EMBODIMENTS

Figure 1:
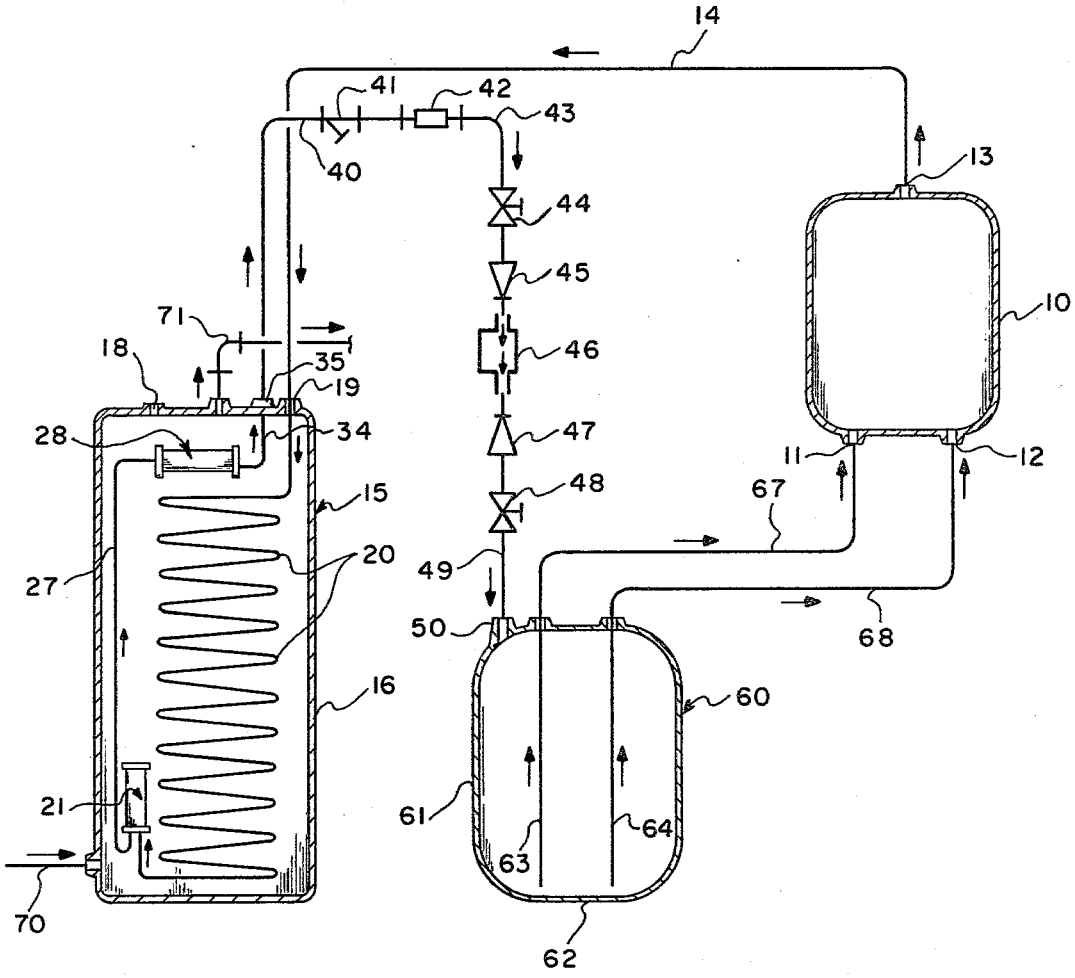
FIG. 1 is a schematic diagram of the apparatus of this invention.

Referring to FIG. 1, compressor 10 is rated at 18,000 BTUs operated on full load at 10.5 amps. This compressor is an open type belt driven direct drive compressor and can receive heat exchange fluid at inlets 11 and 12 at 130° F. or higher. The fluid leaving outlet 13 reaches in the range of 250° to 270° F. and may reach as high as 500° F. without damaging compressor 10. Compressor 10 is operating at 8.5 amps on a 230 volt line and generates heat through heat exchanger 15 of about 33,000 BTUs per hour.

An alternative to compressor 10 is a hermetically sealed compressor with internal windings commonly known as a refrigerant compressor used in air conditioning. This type of compressor is typically rated at 5,000 BTUs per hour and operates at full load at 7.5 amps. This type of compressor is limited as to its temperature imput and is preferably operated with an imput of heat exchange fluid in the temperature range of about 105° F. to a maximum of about 130° F. Operated in the present apparatus, it will compress the fluid to a temperature range of 200° F. to 230° F. at 225 psig operating at 5.1 amps from a 115 volt line.

Figure 2:
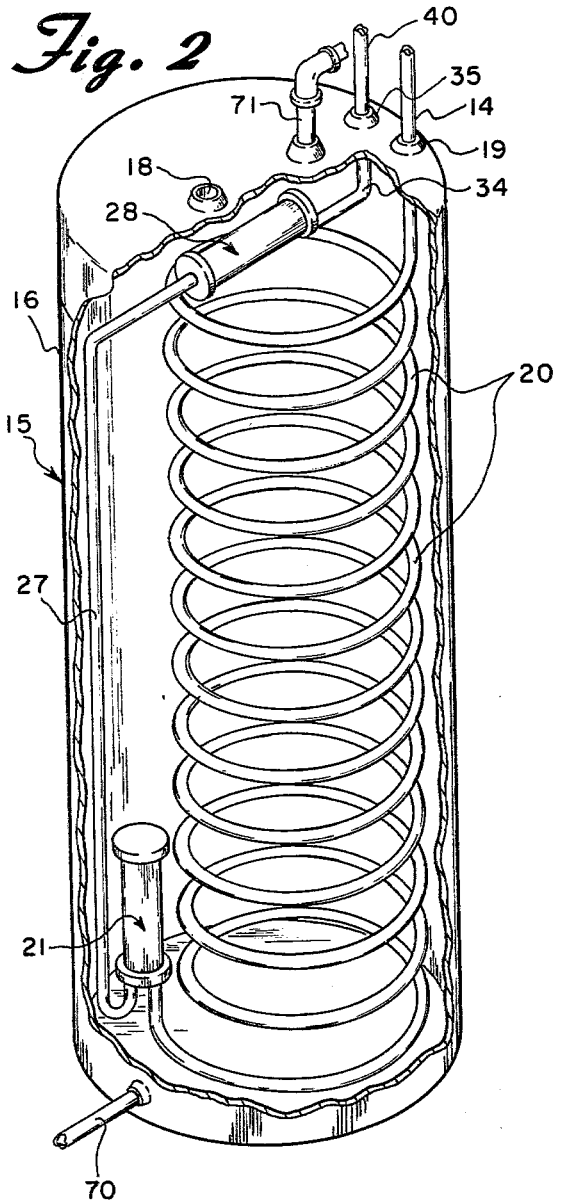
FIG. 2 is a partial cut-out perspective view showing the interior construction of the heat exchanger.
Figure 3:
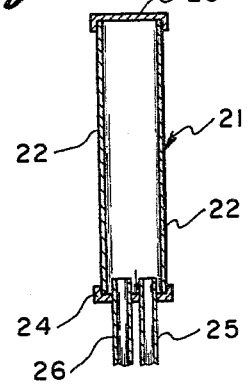
FIG. 3 is a cross-sectional view along Lines 3—3 of FIG. 2 of the first pulsator balance device.
Figure 4:
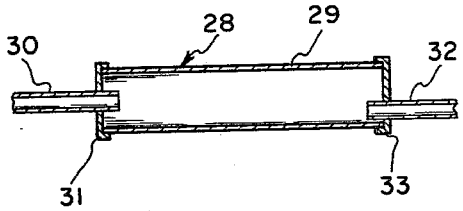
FIG. 4 is a cross-sectional view along Lines 4—4 of FIG. 2 of the second pulsator balance device.
Figure 5:
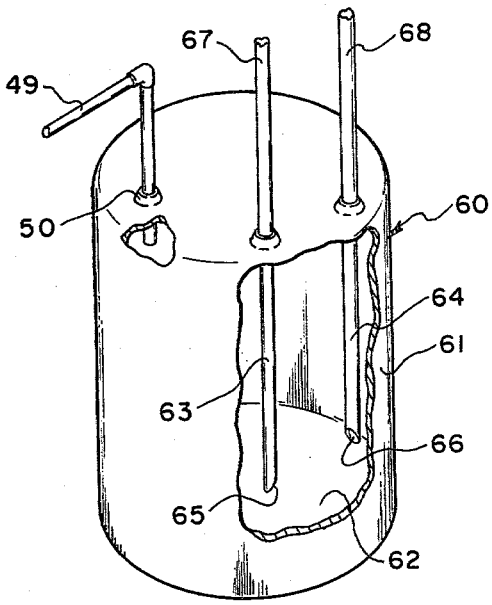
FIG. 5 is a partial cut-out perspective of the expansion tank in the apparatus of FIG. 1.

The heat transfer fluid as it leaves outlet 13 is at about 250° F. and 225 psig traveling along $\frac{3}{8}$ inch OD copper tubing 14, into heat exchanger 15. The schematic of heat exchanger 15 is depicted in FIG. 1 and the interior construction is shown in perspective view FIG. 2. Heat exchanger 15 includes steel fifteen gallon tank 16 which contains water at atmospheric pressure with opening 18 to the atmosphere. The heat exchange fluid enters inlet 19 and passes through fifty feet of ⅜ OD copper tubing 20 coiled to pass through in heat transfer mode with the water in tank 16. Connected at the end of coiled tube 20 is first pulsator balancer 21. As shown in FIG. 3, balancer 21 is a twelve inch long cylinder 22 that is ⅞ inch OD tubing with caps 23 and 24 welded on the ends of cylinder 22. Cap 24 has holes through which inlet tube 25 and outlet tube 26 pass to a level about one inch inside surface of cap 24. The heat exchange fluid travels along ⅜ inch copper tube 27 to secondary pulsator balancer 28, as more fully described in FIG. 4 which is again constructed of ⅞ inch copper OD tubing 29 with inlet tube 30 passing through and welded to cap 31 and outlet tube 32 welded and passing through cap 33 close to the bottom of tube 29 to ⅜ inch copper tube 34 which leads out of heat exchanger 16 at outlet port 35. The heat exchange fluid travels along ⅜ inch copper tubing 40 to dryer and strainer 41 through sight glass 42 which is observed to be in the temperature range of 170° to 200° F. and essentially in a gaseous state and only partially in a flash liquid state preferably being less than 20 percent flash liquid. Connected to the sight glass is two feet of ¼ inch copper tubing 43 connected to valve 44 from which reducing nipple 45 is used to weld to a six inch length of 0.40 inch copper capillary tubing 46 which in turn is welded to expansion nipple 47 connected to valve 48. Connected on the other side of valve 48 is a two foot length of ¼ inch copper tubing 49, as a flow restrictor. The pressure in tube 49 is reduced to about 65 psig. Tubing 49 is connected to expansion system 60 at inlet tube 50. Expansion system 60 is pictured in perspective view in FIG. 4 and includes a five gallon steel tank 61 with bottom 62. A small amount of oil will collect on bottom 62 and be drawn into ½ inch OD copper outlet tubes 63 and 64 which are ½ inch OD copper. Tubes 63 and 64 reach almost to bottom 62 with bevel cuts 65 and 66 to prevent blockage should there by any accumulation of liquid. Outlet tubes 63 and 64 are connected directly to return tubes 67 and 68 which return the heat exchange fluid to inlets 11 and 12 of compressor 10. The heat exchange fluid in tank 61 is about 125° F. and 65 psig as it is returned to compressor 10.

Heat is produced by the heat generator pictured in FIG. 1 by drawing the water from outlet 71 of tank 17 at the rate of two gallons per minute at about 180° F. to produce 33,000 BTUs per hour for heating a multi-room house returning the water along line 70 at approximately 120° F.

The flow restrictor system design will depend upon the size of the compressor and the temperature and pressure of the heat exchange fluid it is capable of handling. When the 5,000 BTU compressor described above is used in the apparatus, a 48 inch length of 0.040 copper capillary tubing is effective to control the heat exchange fluid at about 30 psig and 105° F. as it reenters the small compressor. Since that compressor is a hermetically sealed with internal winding type, the lower temperature and pressure of the inlet fluid is necessary. The amount of the charge of the heat exchange fluid is an element of this invention. For other heating apparatuses such as the heat pump, it is common to charge about 10 pounds of FREON refrigerant with a system utilizing a one ton compressor. In that type of system it is necessary to charge the refrigerant under high pressure. I have found that my heat generator operates more efficiently with only a relatively small charge of heat exchange fluid. For example, in the apparatus described in FIG. 1 through 5, a charge of a mixture of FREON compounds at 65 psig or about 2 pounds by weight of FREON is very effective. As a guide, it is preferred that the heat exchange fluid be charged in an amount of about 0.5 pound to about 1.5 pounds per ton capacity of the compressor. In my apparatus where the compressor is about 2 tons in capacity, 2 pounds of heat exchange fluid provides a good balanced performance. It will be clear that the larger the compressor the larger the overall system will generally be. As a consequence, it is preferred that the heat exchange fluid be charged to a pressure of about 10 pounds to about 100 pounds psig. It is more preferred that the heat exchange fluid be charged to a pressure range of 25 to 85 psig. It is most preferred that the heat exchange fluid be charged to a pressure in the range of 50 to 75 psig, all these pressure ranges being at 70° F. As the amount of the heat exchange fluid is reduced to the lower ends of these ranges, the system will tend to slow down and stop as a result of the heat exchange fluid collecting in one portion of the system and failing to fill out the system and reach back to the compressor inlet. On the other hand, as the amount of heat exchange fluid is increased to the higher ends of these ranges, the inlet temperature of the compressor is increased and the fluid concentration is increased such that the compressor will ultimately heat up and burn out. In addition, as the amount of heat exchange fluid charged is reduced and the efficiency of the heating apparatus is also reduced. While an increase of the charge toward the high end of the range and outside of the range tends to stall the compressor.

The composition of the heat exchange fluid useful for this invention vary widely, but are typically chosen from fluorinated and chlorinated hydrocarbons commonly known in the field of FREON compounds, a registered trademark of E.I. DuPont De Nemours & Co. (Inc.). Typically, the FREON compounds have 1 to 3 carbon atoms with halogen substitutions in the range of 2 to 6 atoms. The fluorine substitutions are one or more. Chlorine substitutions are one or more except that it may be zero when there is more than one fluorine substitution. Typical FREON compounds include trichlorofluoromethane (F 11), dichlorodifluoromethane (F 12), chlorotrifluoromethane, chlorodifluoromethane (F 22) trichlorotrifluoroethane (F 113), dichlorotetrafluoroethane (F 114), chloropentafluorothane, dichlorofluoromethane (F 21), 1-chloro-2,2,2,-trifluorothane (F 13), 2-chloroheptafluoropropane, dichloromonofluoromethane; 1,2-dichloro-1,1,2trifluoroethane, 1,2-dilromo-1,1,2,2,-tetrafluoroethane; methyl fluoride, monochlorofluoromethane, trifluoromethane, 1,1,1,2-tetrafluoroethane, 1,1,1,2,2,-pentafluoropropane, isomers, and the like. These compounds may be used together in mixtures, including various azeotropic mixtures, together on in combination with other heat exchange fluids including but not limited to diethyl ether, dichloromethane, ethane, ethylane, propane, nitrogen, air, ammonia, and the like. Azeotrope compositions of various FREON compounds are effective in admixture with the above and include FREON 500: dichlorodifluoromethane (F 112) and 1,1-difluoroethane; FREON 502: F 22 and F 115; FREON 503: F 13 and F 23; and azeotrope of F 22, F 13 and F 11, and the like. There are a large number of additional compounds which provide a range of efficiency of the above compounds. While this is not intended to limit the present invention, I have found that certain mixtures of these compounds greatly increase the efficiency of the apparatus. For example, a mixture of FREON compounds having condensation points in the range of minus 160° F. to 160° F. at atmospheric pressure and the compounds also having condensation points in the range of minus 40° F. to 200° F. at 200 psig provide excellent results. It will be clear that for compounds such as F 113 the condensation point at 0 psig is about 118° F. so that its condensation point at 200 psig will essentially be off the scale. However, by a selection of at least three FREON compounds spread across the range described above, excellent results are obtained. The apparatus of Claim 1 gives good results with equal parts by weight of F 113, F 13, and F 22. Substitutions and additions to the above compounds may be made into this composition. An easy method of charging the heat exchange fluid to the apparatus is to fill a drum with the proportion of the FREON compounds to be used to a pressure of about 130 psig. The drum is connected by a hose to expansion tank 61 and the pressure allowed to equalize to 65 psig, the volume of the drum being chosen to be approximately equal to that of the volume of the entire system of the apparatus.

It is preferred that the charge of the heat exchange fluid is such that during normal operation there is less than 20 percent flash liquid at any point in the circuit and it is more preferred that the amount of flash liquid be in the range of one to ten percent. It is most preferred that the heat exchange fluid be essentially all in the vaporized form which will normally occur as long as the temperature is maintained about 120° F.

Although not pictured, a circulating fan will generally be utilized in the apparatus of FIG. 1 when the individual components are not fully insulated from the ambient conditions. For example, when tank 61 is merely maintained at a temperature above ambient, a circulating fan will carry heat radiated from the exterior of tank 61 into the ambient air to further heat the surroundings. It is preferred that all components be insulated from ambient to eliminate the necessity of the fan.

The flow restricting system may take the form of a variety of individual elements or a combination of elements to accomplish the same result. The result to be accomplished is to restrict the amount of heat exchange fluid passing through the system so as not to flood the compressor as the temperature and pressure of the intake increase, and to cause it to flow efficiently in the system. One system alone or in combination with other elements of restricting the flow is to include a reduced charge of the heat exchange fluid maintaining it at an undercharged amount as compared to standard heat pumps, as described above. Another system alone, or in combination with a limited charge is a flow restrictor placed in the conduit after the heat exchanger and before there is a major drop in the temperature and pressure of the fluid. An example of the flow restrictor is a capillary tube of sufficient length and reduced cross-sectional area to limit the flow returning to the compressor. The capillary tube is preferably less than ten percent of the flow cross-sectional area of the conduit and is more preferably less than five percent of the cross-sectional area. It is most preferred that it is less than three percent of the cross-sectional area of the conduit throughout the rest of the apparatus. The larger the compressor, the larger and shorter the capillary should be. For example, if the compressor size is doubled, a general guide would be to double the capillary cross-sectional area or decrease the length of the tube, according to instructions of the manufacturer.

The condition of the expansion tank relative to ambient temperature is important to the performance and control of the apparatus. In order to control the apparatus and obtain the necessary efficiency, there shall be no significant heat transfer from the ambient surrounding conditions to the expansion system. It is preferred that the expansion system be maintained at a temperature at or slightly higher than that of the ambient condition. In that way, there cannot be a significant heat transfer from the ambient to the expansion system. An alternative method of eliminating heat transfer is to efficiently insulate the expansion system from the ambient conditions.

It is preferred that the flow restrictor be in the form of a capillary tube providing the major portion of the pressure drop along the heat exchange circuit. For example, as the heat exchange fluid passes out of the restrictor, it is possible for the fluid pressure to drop from about 200 psig to about 30 psig in the expansion system.

It is also preferred that the major temperature drop be in the fluid expansion system. This is significant when it is realized that the purpose of the apparatus is to heat a second heat exchange fluid so as to transfer heat externally from the apparatus for other uses. For example, it is not uncommon for the heat exchange fluid to drop from about 220° to about 180° while passing through the heat exchanger, thus providing that amount of corresponding heat outside the generator. On the other hand, during the further flow inside the circuit, the temperature drop in the fluid expansion system may be from about 180° to about 110° F. In the above example, the heat exchange fluid re-enters the compressor at about 110° F. and 30 psig.

To further compliment the flow restriction system of this invention, it is preferred that a pulsating and balancing system be employed. This system is at least one and preferably a series of expansion chambers in the conduit inside the heat exchanger to maintain the gaseous or flash liquid state of the fluid throughout the entire circuit.

The term "flash liquid" state as used throughout this specification refers to a cloud of microscopic droplets as formed in a non-newtonian flow of the gaseous mixture of the heat exchange fluid in my invention.

While this invention has been described with reference to the specific embodiments disclosed herein, it is not confined to the details set forth and the patent is intended to include modifications and changes which may come within and extend from the following claims.

I claim:

1. An apparatus for generating heat comprising:

(a) a compressor having an inlet and an outlet, (b) a prime mover means operably coupled to drive the compressor, (c) a conduit means connected to the compressor inlet and to the compressor outlet, (d) a heat exchange fluid charged in the apparatus at a pressure in the range of 10 to 100 psig at 70° F., (e) a heat exchanger means capable of transferring heat from the heat exchange fluid to a second fluid for use outside the apparatus, (f) a flow restricting means to restrict the volume of heat exchange fluid reaching the compressor, and (g) a fluid expansion means to cause the expansion of the heat exchange fluid to be entirely in a gaseous state controlled such that no significant heat transfer is made from ambient conditions (h) wherein the conduit means interconnects elements (a), (c), (f) and (g) in series to carry the heat exchange fluid from the compressor outlet around the system through each element and back to the compressor inlet.

2. The apparatus of claim 1 wherein heat exchange fluid is maintained in a gaseous state or flash liquid state throughout the circuit.

3. The apparatus of claim 1 wherein heat exchange means is a heat exchanger provided with a first fluid path for the heat exchange fluid and a second fluid path containing a second fluid, each path having an outlet and an inlet for passage of the fluids therethrough in heat exchanging relationship to each other.

4. The apparatus of claim 1 wherein flow restricting means is a capillary tube of a size reducing the flow cross-section to no more than ten percent of that of the conduit.

5. The apparatus of claim 1 wherein the flow restricting means is a capillary tube which is no more than five percent of the cross-sectional flow area of the conduit.

6. The apparatus of claim 1 wherein the fluid expansion means is a tank controlled at or slightly higher temperature than ambient temperature.

7. The apparatus of claim 1 wherein an oil vapor drawing means is provided in the fluid expansion means such that heat exchange fluid is drawn into the conduit to the compressor inlet in close proximity to liquid oil as to entrain oil in the vapor which enters the compressor.

8. The apparatus of claim 3 wherein a pulsator balance means is included in the circuit in the heat exchanger in the fluid path for the heat exchange fluid to create a pulsation flow of heat exchange fluid in a gaseous or flash liquid state through system.

9. The apparatus of claim 1 wherein the flow restricting means is constructed such that the major portion of the pressure drop of the heat exchange fluid between the outlet and the inlet of the compressor occurs passing through the flow restricting means.

10. The apparatus of claim 1 wherein the fluid expansion means is constructed such that the major portion of the temperature drop of the the heat exchange fluid between the outlet and inlet of the compressor is during passage through the fluid expansion means.

11. The apparatus of claim 1 wherein the heat exchange fluid comprises at least three chlorinated fluorinated substituted saturated hydrocarbon having one to three carbon atoms with total halogen substitution in the range of two to six.

12. The apparatus of claim 11 wherein the heat exchange fluid is charged in the amount of 0.5 pound to 1.5 pounds per ton capacity of the compressor.

13. The apparatus of claim 1 wherein the heat exchange fluid is a miscible selection of heat exchange fluids having condensation points in the range of minus 160° F. to 160° F. at atmospheric pressure and condensation points in the range of minus 40° F. to 200° F. at 200 psig.

14. The apparatus of claim 1 wherein the heat exchange fluid is charged to the apparatus at a pressure in the range of 25 to 80 psig at 70° F.

15. The apparatus of claim 1 wherein the heat exchange fluid is charged in the apparatus at a pressure in the range of 50 to 75 psig at 70° F.

16. The apparatus of claim 1 wherein the pressure and temperature of the heat exchange fluid is substantially increased during the passage through the compressor and is decreased during passage through the fluid circuit from the outlet to the inlet of the compressor.

17. An apparatus for generating heat comprising (a) a compressor having an inlet and an outlet, (b) a prime mover means operably coupled to the compressor, (c) a heat exchange means capable of transferring heat from the heat exchange fluid to a second fluid capable of transferring heat outside the apparatus the heat exchange means having an inlet and an outlet for the heat exchange fluid, (d) conduit means connecting the outlet of the compressor to the inlet of the heat exchange means, (e) a flow restricting means having an inlet and an outlet to restrict the volume of the heat exchange fluid reaching the compressor, (f) conduit means connecting the heat exchange means outlet to the inlet of the flow restricting means, (g) a fluid expansion means having an inlet and an outlet, to cause the heat exchange fluid to reach the gaseous state, being controlled that there is not significant heat transfer from ambient conditions to the fluid expansion means, (h) conduit means connecting the outlet of the flow restricting means to the fluid expansion means inlet and from the fluid expansion means outlet to the compressor inlet, and (i) a charge of heat exchange fluid in all of the above elements at a pressure in the range of 10 to 100 psig at 70° F.

18. An apparatus for generating heat comprising (a) a compressor having an inlet and an outlet (b) a prime mover means operably coupled to drive the compressor, (c) a conduit means connected to the compressor inlet and to the compressor outlet, (d) a heat exchange fluid charged in the apparatus at a pressure in the range of 10 to 100 psig at 70° F., (e) a heat exchanger means capable of transferring heat from the heat exchange fluid to a second fluid for use outside the apparatus, (f) a flow restricting means to restrict the volume of heat exchange fluid reaching the compressor, and (g) a fluid expansion means to cause the expansion of the heat exchange fluid to be entirely in a gaseous state controlled such that no significant heat transfer is made from ambient conditions, and (h) a pulsator balance means in the fluid path for the heat exchange fluid to creat a pulsation flow of heat exchange fluid in a gaseous or flash liquid state through the system, (i) wherein the conduit means interconnects elements (f), (g) and (h) in series to carry the heat exchange fluid from the compressor outlet around the system through each element and back to the compressor inlet.

19. The apparatus of claim 18 wherein the pulsator balance means comprises a primary pulsator accumulator comprising a container in the heat exchange fluid circuit located inside the second fluid path in the cooler portion of that path which causes the heat exchange fluid to be placed in a flash liquid state and a secondary pulsator system, comprising a second container in the heat exchange fluid circuit located inside the second fluid path at the hottest portion of that path constructed such that the flash liquid and/or gaseous heat exchange fluid fills only a portion of the second container and causea a pulsation flow of the heat exchange fluid out of the heat exchanger along the circuit.

20. An apparatus for generating heat comprising:

(a) a compressor having an inlet and an outlet (b) a prime mover means operably coupled to drive the compressor, (c) a conduit means connected to the compressor inlet and to the compressor outlet, (d) a heat exchange fluid charged in the apparatus at a pressure in the range of 10 to 100 psig at 70° F. and is maintained in a gaseous state or flash liquid state throughout the apparatus, (e) a heat exchanger means capable of transferring heat from the heat exchange fluid to a second fluid for use outside the apparatus, (f) a flow restricting means to restrict the volume of heat exchange fluid reaching the compressor, and (g) a fluid expansion means to cause the expansion of the heat exchange fluid to be entirely in a gaseous state controlled such that no significant heat transfer is made from ambient conditions, (h) wherein the conduit means interconnects elements (a), (c), (f) and (g) in series to carry the heat exchange fluid from the compressor outlet around the system through each element and back to the compressor inlet.

* * * * *